US011587469B2

(12) United States Patent
Jaap et al.

(10) Patent No.: US 11,587,469 B2
(45) Date of Patent: Feb. 21, 2023

(54) INDICATORS FOR INDUSTRIAL DEVICES

(71) Applicant: ROCKWELL AUTOMATION TECHNOLOGIES, INC., Mayfield Heights, OH (US)

(72) Inventors: Andrew J. Jaap, Milwaukee, WI (US); Andrew E. Carlson, Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 79 days.

(21) Appl. No.: 17/023,109

(22) Filed: Sep. 16, 2020

(65) Prior Publication Data

US 2021/0090469 A1 Mar. 25, 2021

Related U.S. Application Data

(60) Provisional application No. 62/904,789, filed on Sep. 24, 2019.

(51) Int. Cl.

| | |
|---|---|
| ***G09F 3/02*** | (2006.01) |
| ***G09F 3/00*** | (2006.01) |
| ***G09F 3/04*** | (2006.01) |
| ***H01H 71/04*** | (2006.01) |
| ***H01H 73/16*** | (2006.01) |
| ***H01H 9/18*** | (2006.01) |
| ***H01H 71/06*** | (2006.01) |
| *H01H 71/02* | (2006.01) |

(52) U.S. Cl.

CPC ..... *G09F 3/0294* (2013.01); *G09F 3/04* (2013.01); *H01H 9/18* (2013.01); *H01H 71/04* (2013.01); *H01H 71/06* (2013.01); *H01H 73/16* (2013.01); *G09F 2003/0276* (2013.01); *H01H 71/02* (2013.01); *H01H 71/0264* (2013.01)

(58) Field of Classification Search

CPC ..... G09F 3/0294; G09F 3/04; H01H 9/18; H01H 71/06

USPC ..... 200/308

See application file for complete search history.

(56) References Cited

U.S. PATENT DOCUMENTS

| | | | | |
|---|---|---|---|---|
| 7,246,824 | B2 | 7/2007 | Hudson | |
| 7,963,563 | B2 | 6/2011 | Spencer et al. | |
| 8,680,400 | B2 | 3/2014 | Hermes | |
| 8,755,121 | B2 | 6/2014 | Cape et al. | |
| 2008/0197620 | A1* | 8/2008 | Spencer | B42D 25/29 283/81 |
| 2013/0264180 | A1* | 10/2013 | Broghammer | H01H 71/06 200/308 |

FOREIGN PATENT DOCUMENTS

| | | | |
|---|---|---|---|
| DE | 102008058871 | B3 | 6/2010 |
| FR | 2848022 | A1 | 6/2004 |

OTHER PUBLICATIONS

European Patent Office. Extended European Search Report for application 20197729.5, dated Jan. 29, 2021. 7 pages.

Eyecap International Ltd., Cable Connectors, www.eyecap.kr/A_01.do, Copyright 2019 EyeCap International Ltd., 3 pages.

* cited by examiner

*Primary Examiner* — Edwin A. Leon
*Assistant Examiner* — Iman Malakooti
(74) *Attorney, Agent, or Firm* — Quarles & Brady LLP

(57) ABSTRACT

An indicator is provided that can couple, without a fastener, to a housing of an industrial device.

19 Claims, 5 Drawing Sheets

INDICATORS FOR INDUSTRIAL DEVICES

CROSS-REFERENCES TO RELATED APPLICATIONS

This application is based on, claims the benefit of, and claims priority to U.S. Provisional Patent Application No. 62/904,789, filed Sep. 24, 2019, which is hereby incorporated herein by reference in its entirety for all purposes.

FIELD OF THE INVENTION

The present disclosure generally relates to methods and systems for identifying industrial devices. In particular, the present disclosure generally relates to indicators identifying industrial automation devices.

BACKGROUND

Devices used in industrial settings (e.g., industrial automation systems) include but are not limited to drives such as variable speed drives, circuit breakers, switches such as disconnect switches, overload relays, and motor starters. The devices can be arranged in panels where a worker may have difficulty quickly identifying a specific device, for example a disconnect switch for "Pump A," in a panel with a large number of disconnect switches that may be the same model. In some situations, "downtime" of a device within an automation setting (e.g., within a manufacturing line) can be costly.

SUMMARY

In one embodiment, an industrial automation device indicator system is provided by the current disclosure. The system includes a plurality of indicators and a plurality of industrial automation devices positioned in side-by-side orientation to one another. Each of the said plurality of industrial automation devices has a housing with a front face and is included in a plurality of housings. The front face is sized and adapted to receive an indicator included in the plurality of indicators. The indicator included in the plurality of indicators is positioned along an edge of the front face. Each of the indicators the plurality of indicators is positioned on a housing included in the plurality of housings in a common orientation to one another. A first industrial automation device included in the plurality of industrial automation devices includes inputs for connection to a motor of a first application, and a second industrial automation device included in the plurality of industrial automation devices includes inputs for connection to a motor of a second application. The first industrial automation device and the second industrial automation device are adjacent to one another.

In the system, a first indicator included in the plurality of indicators may be a first color, and the first indicator may be coupled to the first industrial automation device. A second indicator included in the plurality of indicators may be a second color, and the second indicator may be coupled to the second industrial automation device.

In the system, each indicator included in the plurality of indicators may include at least one of rubberized plastic or silicone.

In the system, the plurality of industrial automation devices may include at least one of a variable speed drive, a circuit breaker, a disconnect switch, an overload relay, or a motor starter.

In another embodiment, an indicator including at least one of rubberized plastic or silicone is provided by the current disclosure. The indicator is configured to couple without a fastener to an edge of a housing of an industrial device or an opening included in the housing of the industrial device.

The indicator may be configured to couple to a first surface and a second surface of the housing. The first surface may be arranged orthogonally to the second surface. The indicator may be configured to couple to a third surface of the housing.

The indicator may be patterned in color.

The indicator may be configured to couple to a plurality of industrial devices having different housing constructions.

The fastener may be at least one of an adhesive, a screw, or a clamp.

The industrial device may be an industrial automation device. The industrial automation device may be at least one of a variable speed drive, a circuit breaker, a disconnect switch, an overload relay, or a motor starter.

In yet another embodiment, an indicator including at least one of rubberized plastic or silicone and configured to couple without a fastener to a surface in an opening included in a housing of an industrial automation device is provided by the current disclosure.

The indicator may further include an engagement portion extending away from an insertion surface.

In the indicator, a cross sectional area of the engagement portion may be cross shaped.

In the indicator, a cross sectional area of the engagement portion may decrease as the engagement portion extends further away from the insertion surface.

The indicator may be configured to change color in response to temperature changes.

The indicator may indicate a system group that includes the industrial device. The industrial automation device may be a disconnect switch.

These and other benefits may become clearer upon making a thorough review and study of the following detailed description. Further, while the embodiments discussed above a listed as individual embodiment, it is to be understood that the above embodiments, including all elements contained therein, can be combined in whole or in part.

Figure 1:
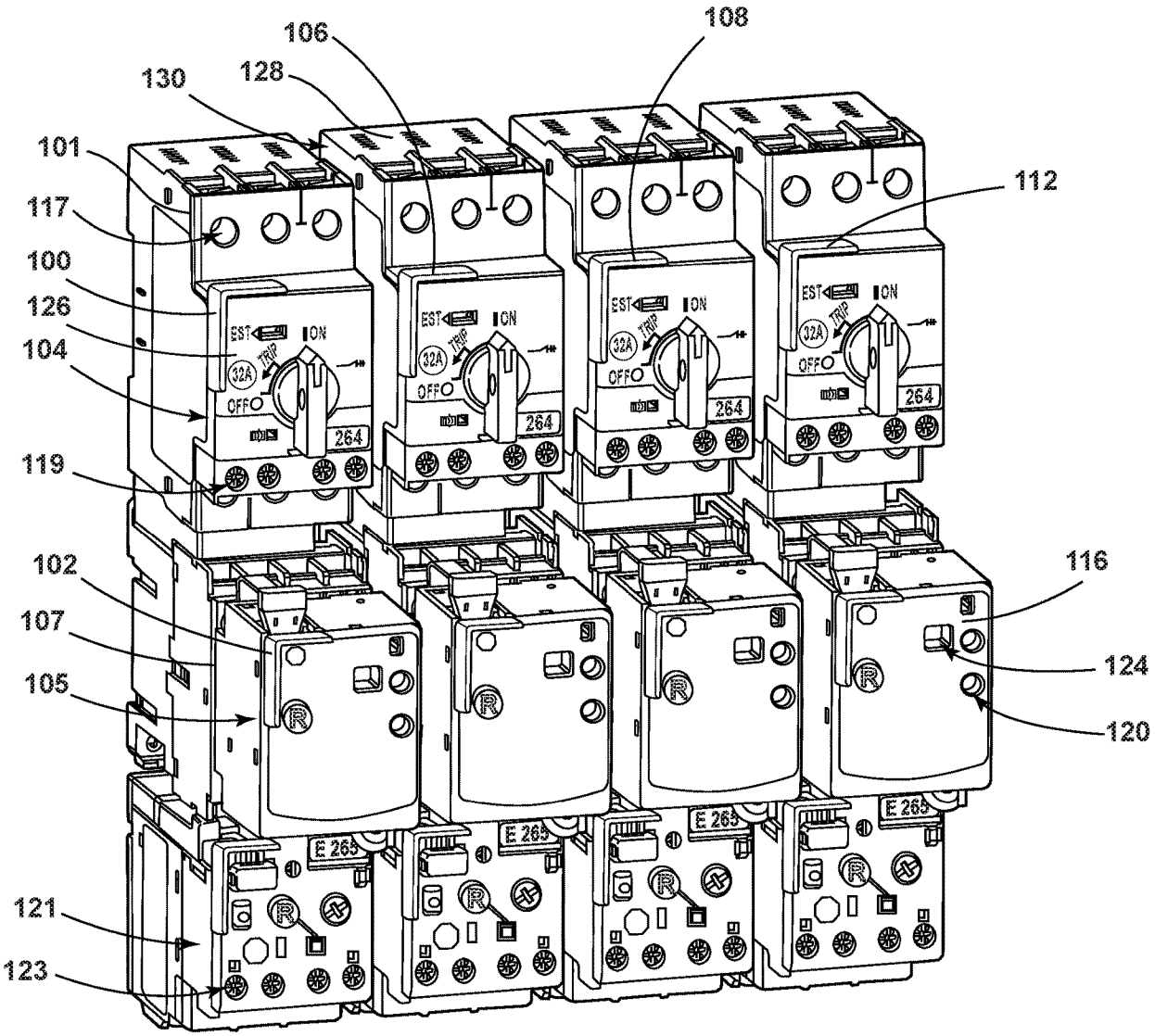
FIG. 1 is a front view of various indicators coupled to housings of various industrial automation devices.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

Indicators to identify industrial automation devices in order to assist workers in identifying a specific device for a specific piece of industrial equipment as well as identify potential issues such as a device overheating are described. The indicators can be placed on a housing of an industrial automation device, including but not limited to: drives such as variable speed drives, circuit breakers, switches such as disconnect switches, overload relays, and motor starters.

There is a need to quickly and accurately identify industrial automation devices in order to service, repair, examine, or otherwise interact with the industrial automation devices. Tens of thousands of dollars per hour can be lost when production machines are shut down. The quicker issues can be identified and fixed, the quicker the machine can resume production.

Conventional identification methods include name plates affixed to an industrial automation device via a fastener, such as one or more screws. The name plates generally do not allow for quick identification of individual industrial automation devices because they have identification information printed in small type, do not utilize any unique identifying features, and appear generally identical from a distance (e.g., five feet). A worker may have to closely read each name plate individually (e.g., from one foot away) in order to determine which specific industrial automation device needs to be examined, which can be inefficient.

Additionally, these conventional name plates are time-consuming to install, and are not readily reusable. For example, name plates that require screws can take time to install, and name plates that require adhesives generally cannot be reused without applying new adhesive. Furthermore, name plates are generally customized (e.g., etched) and cannot be moved to another device.

In contrast, the indicators provided in the present disclosure overcome the aforementioned drawbacks. For example, the indicators provided herein can removably attach to a portion of an industrial automation device. In some instances, the indicators can be attached to an edge or a screw hole corresponding to the industrial automation device. Notably, the indicators may be attached without a fastener (which can aid in the reuse of the indicators). As another example, the indicators can be a variety of colors and/or patters, which can provide color "codings" for a device type, machine group, and/or other desired classifications. The color codings can allow a worker (e.g., a technician) to easily identify the specific industrial automation device they are looking for. For example, the worker may know a pump included in a machine with three pumps is malfunctioning. Although the worker can readily locate a panel corresponding to the machine, the panel may include (as an example) twenty circuit breakers, only three of which are associated with the pumps. The indicators can be used to quickly identify the type of device that each circuit breaker is connected to (e.g., blue for pumps, green for impellers, etc.). The worker then knows to only examine the circuit breakers with the indicators associated with pumps (e.g., only the blue indicators), and can efficiently determine which circuit breaker has been tripped, rather than looking through each and every breaker (i.e., up to twenty circuit breakers). Thus, the indicators can save incredibly valuable time. As discussed above, there can be direct financial benefits to efficiently addressing a run-time problem. Additionally, as will be described, the indicators can provide other advantages over the previous techniques, such as providing color changes based on temperature.

Referring now to the figures, FIG. 1 shows various indicators coupled to housings of various industrial automation devices. A first indicator 100 can be coupled to a first housing 104. The first housing 104 can be included in a first industrial automation device 101. The first industrial automation device 101 can be a disconnect switch. In some embodiments, the first indicator 100 can be formed from rubberized plastic and silicone. Other materials such as Polypropylenes, Polyamides, and/or Polybutylene Terephthalate (PBT) can also be used. Rubberized plastic and/or silicone can provide a grippy surface that allows the indicators to stay in place when coupled to housings. Polypropylenes, Polyamides, and/or PBT can provide more rigidity than rubberized plastic and/or silicone alone. Polypropylenes, Polyamides, and/or PBT can be combined with silicone if more rigidity and/or robustness is needed than silicone alone can provide. Polypropylenes, Polyamides, and/or Polybutylene Terephthalate can also provide thermal resistance and/or chemical resistance not afforded by rubberized plastic and/or silicone alone. Additionally, some applications may restrict products with silicone due to potential outgassing, and indicators made from Polypropylenes, Polyamides, and/or Polybutylene Terephthalate may be used in place of silicone.

In some embodiments, the industrial automation devices, and by extension, the housings of the industrial automation devices, can be positioned in side-by-side orientation to one another. Industrial automation devices are commonly arranged in this fashion in a rack. In some embodiments, each housing can include a front face sized to receive an indicator. The first housing 104 can include a front face 126. In some embodiments, the front face 126 can receive an indicator positioned along an edge of the front face 126. Positioning the indicator along an edge of the front face can provide easy visibility (e.g., of an identification color) for a worker, as well as allow the indicator to couple to a variety of different industrial automation devices having a common edge and/or front face.

In some embodiments, the first indicator 100 can be coupled to the housing 104 without the use of an adhesive, screw, clamp, or other fastener. The first indicator 100 may be configured to remain coupled to the housing 104 even in the case of vibration. To first indicator 100 can be formed to generally follow the shape of one or more edges of the first housing 104. Along with the first indicator 100 being formed to fit one or more edges of the first housing 104, the rubberized plastic and silicone construction of the first indicator 100 can grip the first housing 104 to sufficiently couple the first indicator 100 to the first industrial automation device 101. The rubberized plastic and silicone construction can provide a semi-flexible indicator that can stretch to fit and grip slightly different housing sizes while still maintaining reusability. The first indicator 100 can include one or more interfaces for individual marking of each terminal and/or break-away markings to show a date of installation of the indicator.

A second indicator 102 can be coupled to a second housing 105 of a second industrial automation device 107. The second indicator 102 and the first indicator 100 can be sized approximately the same and/or be colored the same color, such as yellow, though other colors such as blue, green, red, brown, white, black, pink, purple, orange, and/or combinations thereof. The first indicator 100 and the second indicator 102 can be the same color in order to indicate multiple devices corresponding to the same piece (or type) of industrial equipment. For example, the first industrial automation device 101 can be a disconnect switch for a pump, and the second industrial automation device 107 can be a drive for the pump. In some embodiments, the first industrial automation device 101 can be a variable speed drive, a circuit breaker, a switch such as a disconnect switch, an overload relay, and/or a motor starter. Using the same color indicators can allow a worker to quickly find relevant devices for the pump because the worker may only need to look for a color, such as yellow, rather than reading individual equipment tag numbers of multiple devices, which can be time consuming and require a worker to be located closer to the devices. Saving time can be valuable for finding a specific piece of equipment during routine or emergency maintenance on large machines that may lose thousands or tens of thousands of dollars in lost productivity for every hour the machine is not running.

The first housing 104 and the second housing 105 can be shaped similarly along one or more edges, such as a top edge and a left edge. When different housing share edge designs, indicators of the same shape can be used across multiple device types (i.e. disconnect switches and drives). Alternatively, multiple different indicator shapes and sizes can be used to cover a range of devices with indicators of the same color.

Indicators of different colors can be used to uniquely identify equipment. For example, the first indicator 100, a third indicator 106, and a fourth indicator 108 can all be coupled to a specific model of a device and be of different colors, which can allow a worker to better distinguish a row of disconnect switches, for example.

In some embodiments, multiple indicators can be positioned on multiple industrial automation devices having a common orientation to one another. For example, the indicators can be used to differentiate a number of industrial automation devices included in a rack. In some embodiments, the first industrial automation device 101 can be positioned to have a common orientation to a third industrial automation device 128 having a housing 130.

In some embodiments, the first industrial automation device 101 and the third industrial automation device 128 can be similar (e.g., identical) devices having the same overall orientation. For example, the first industrial automation device 101 and the third industrial automation device 128 may be circuit breakers included in a rack, which is commonly found in manufacturing facilities. In some embodiments, the first industrial automation device 101 can include at least one edge that is substantially parallel with an edge included in the third industrial automation device 128. In some embodiments, the first industrial automation device 101 can include at least one face that is substantially coplanar with at least one face included in the third industrial automation device 128. In some embodiments, the first industrial automation device 101 can include at least one face that is included in a plane substantially parallel to another plane including at least one face included in the third industrial automation device 128. In some embodiments, the first industrial automation device 101 and the third industrial device 128 can be adjacent or otherwise proximate to one another.

In some embodiments, the third indicator 106 can be positioned on the housing 130 of the third industrial device 128. In some embodiments, the first indicator 100 can be positioned on the first housing 104 in the same orientation as the third indicator 106 is positioned on the housing 130 of the third industrial device 128. Using a common orientation to position the indicators can allow a worker to quickly scan the indicators and identify a relevant industrial automation device.

In some embodiments, the first industrial automation device 101 can include inputs for connection to a motor of a first application, and the third industrial automation device 128 can include inputs for connection to a motor of a second application. In some embodiments, the first industrial automation device 101 and the third industrial automation device 128 can be adjacent to one another. In some embodiments, the first indicator 100 and the third indicator 106 can be different colors. For example, the first indicator 100 can be green, and the third indicator 106 can be blue. Using different colors can allow a worker to easily identify automation devices belonging to different applications (e.g., the first application and the second application). For example, when troubleshooting the first application, the worker can ignore all of the devices associated with the second application (e.g., all devices with blue indicators) and only focus on devices associated with the first application (e.g., all devices with green indicators), thereby saving valuable time.

In some embodiments, an indicator such as a fifth indicator 112 can be colored with a pattern such as camouflage. Additionally, certain indicators such as the fifth indicator 112 can be sized differently than other indicators, such as the first indicator 100. The difference in size between indicators can also be used to better distinguish industrial automation devices to a worker.

As will be explained further below, certain housings such as a third housing 116 can include openings such as a first opening 120 and/or a second opening 124 to which a "plug-type" indicator can be inserted and thereby coupled to the housing 116. Certain housings such as the first housing 104 can include openings such as a third opening 117 and/or a fourth opening 119 that can accommodate terminal screws. Other housings such as a fourth housing 121 can include a fifth opening 123 that can accommodate a terminal screw. A "plug-type" indicator can be inserted into one of the third opening 117, the fourth opening 119, or the fifth opening 123 and be placed in contact or close proximity with a terminal screw.

Figure 2:
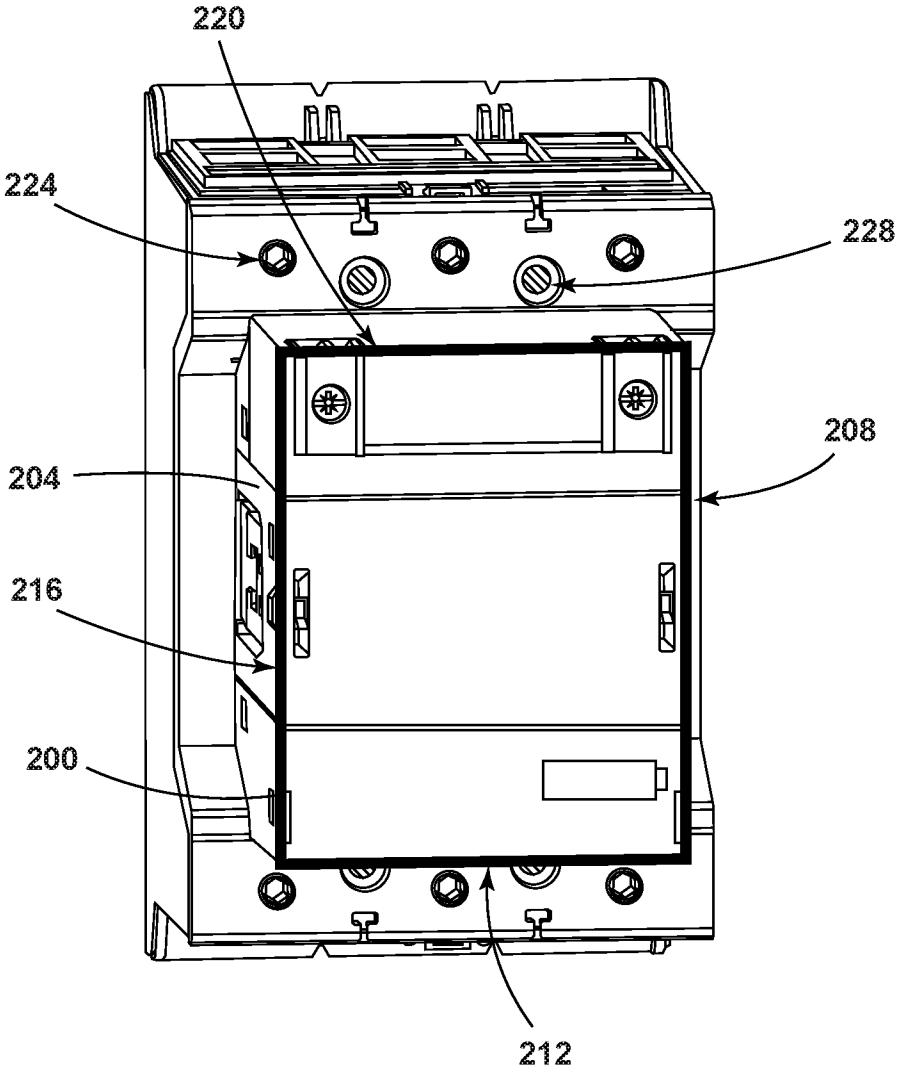
FIG. 2 is another exemplary indicator.

Referring now to FIG. 1 as well as FIG. 2, an exemplary sixth indicator 200 is shown. The sixth indicator 200 can be coupled to a fifth housing 204 and made of materials similar to the first indicator 100 described above. The sixth indicator 200 can include a first length 208, a second length 212, a third length 216, a fourth length 220, or a combination thereof. For example, the sixth indicator 200 may include the first length 208, the third length 216, and the fourth length 220. In some embodiments, the sixth indicator 200 can be formed using an injection molding process. In some embodiments, the sixth indicator 200 can be formed using an extrusion process, such as if the sixth indicator only includes a single length such as the fourth length 220.

As will be explained further below, the housing 204 can include openings such as a sixth opening 224 and/or a seventh opening 228 to which a "plug-type" indicator can be inserted and thereby coupled to the housing 204.

Figure 3:
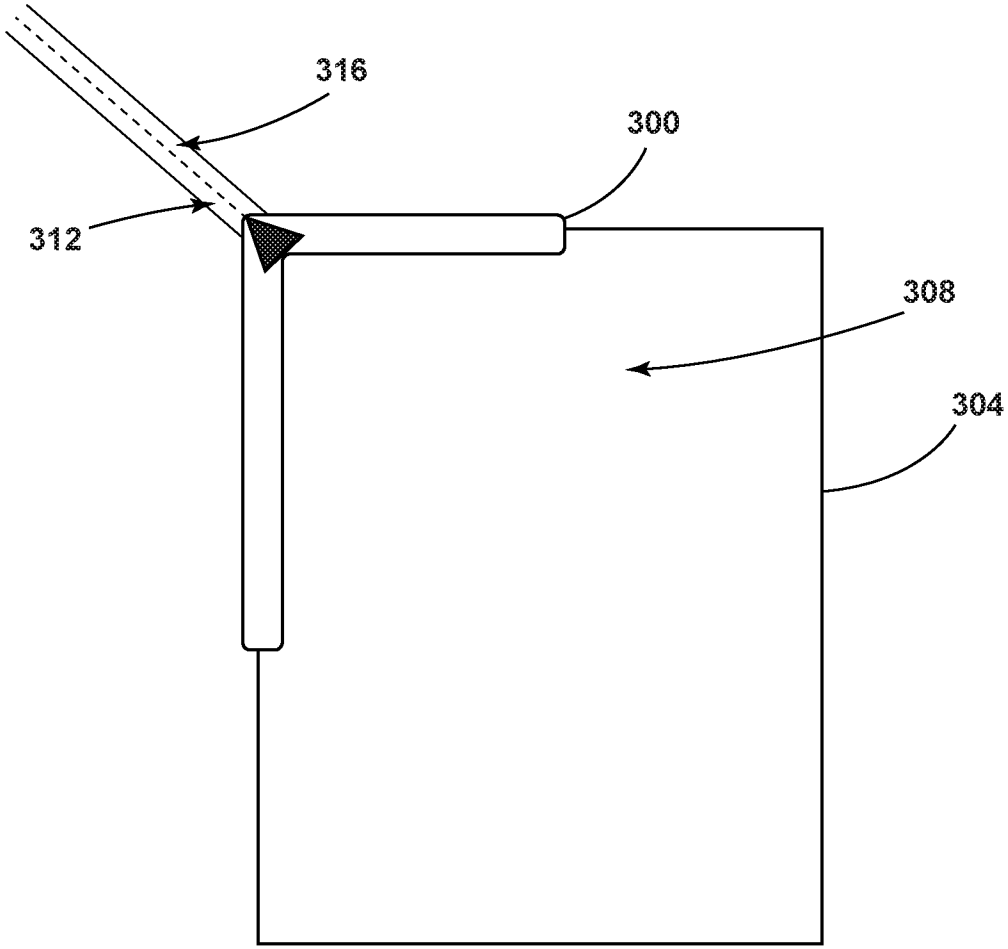
FIG. 3 is yet another exemplary indicator and another exemplary housing.

Referring now to FIG. 3, an exemplary seventh indicator 300 and an exemplary sixth housing 304 are shown. The seventh indicator can be constructed from materials similar to the first indicator 100. The sixth housing 304 is shown as a simplified shape having a first surface 308, a second surface 312, and a third surface 316. The seventh indicator 300 can be formed to couple to at least two surfaces of the sixth housing 304. In some embodiments, the seventh indicator 300 can be formed to couple to at least a portion of the third surface 316 and at least a portion of the first surface 308. In some embodiments, the seventh indicator 300 can be formed to couple to at least a portion of the third surface 316, at least a portion of the second surface 312, and at least a portion of the first surface 308 to form a "dovetail" shape. In some embodiments, each of the first surface 308, the second surface 312, and the third surface 316 can be arranged orthogonally the other surfaces. For example, the first surface 308 can be arranged orthogonally to both the second surface 312 and the third surface 316.

Figure 4B:
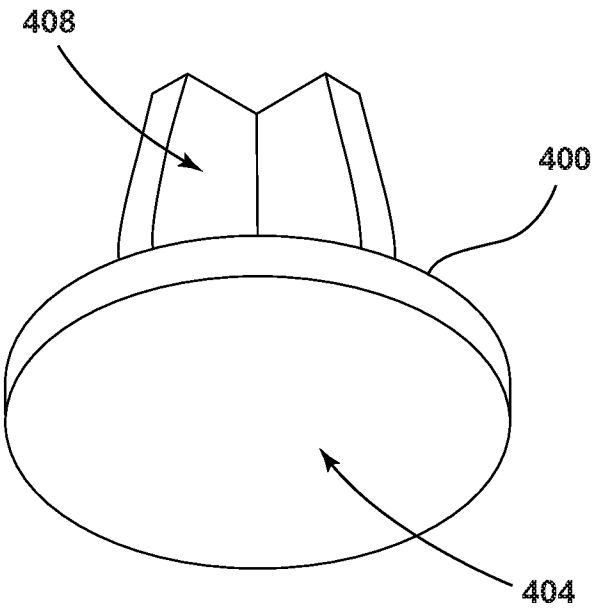
FIG. 4B is a second view of the plug indicator of FIG. 4A.
Figure 4A:
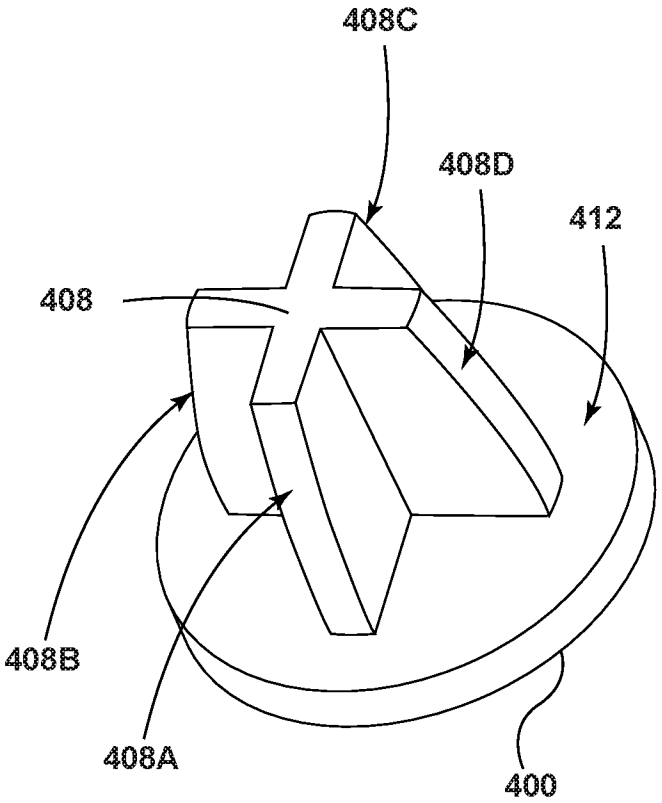
FIG. 4A is a first view of a plug indicator.

Referring now to FIGS. 1 and 2 as well as FIG. 4A and FIG. 4B, a plug indicator 400 is shown. The plug indicator 400 can be constructed from materials similar to the first indicator 100, and be colored various colors and/or patterns such as camouflage as described above. The plug indicator 400 can include an indicator surface 404, an engagement portion 408, and an insertion surface 412 arranged opposite the indicator surface 404. The engagement portion 408 may be referred to as "fins," and the insertion surface 412 may be referred to as a "base." The plug indicator 400 can be at least partially inserted to an opening of a housing such as the first opening 120, the second opening 124, the third opening 117, the fourth opening 119, the fifth opening 123, the sixth opening 224, or the seventh opening 228 as described above. The plug indicator 400 can be used to identify an industrial automation device and/or indicate temperature of the industrial automation device.

In some embodiments, the plug indicator 400 can be constructed from materials that may change color with a varying temperature. For example, a plug indicator could display a first color, such as red, at a first temperature such as 40° C., and a second color, such as white, at a second temperature such as 70° C. A worker can then identify potential device issues by identifying colors corresponding to higher temperatures, such as red corresponding to 120° F. If an industrial automation device is operating at a higher temperature, the device may be at a higher risk for damage.

In some embodiments, the plug indicator 400 can be constructed from a thermochromic material having either a reversible or irreversible color change. Having a reversible color change can allow a worker to identify if a device is currently overheating, while an irreversible color change can allow the worker to identify if they device has overheated since installation, which may help the worker in troubleshooting industrial devices. Thus, a plug indicator formed with a thermochromic material having an irreversible color changes may be replaced with a new plug indicator after the previous plug indicator has changed colors. In some embodiments, the thermochromic material can include silicone having a dye to cause a color change at a predetermined temperature (e.g., about 70° C.). It is contemplated that the plug indicator could be configured to change color at a temperature ranging from about 60° C. to 75° C., which are common temperature ratings of conductors.

Plug indicators inserted into certain opening such as the third opening 117, the fourth opening 119, the fifth opening 123 can be placed in contact or close proximity with terminal screws and/or terminated wires. In the event that a device is malfunctioning, the terminal screws may increase in temperature and cause the plug indicator to change colors. A maintenance worker can then identify that the device is malfunctioning.

The engagement portion 408 of the plug indicator 400 can be inserted into a given opening, for example the third opening 117, with the indicator surface 404 generally facing towards a worker. In some embodiments, the indicator surface 404 can be larger than a cross sectional area of the opening. In some embodiments, the indicator surface 404 can be a flat surface. The engagement portion 408 may extend away from the insertion surface 412 for a distance such as 2 mm. The engagement portion 408 can be formed with a "cross" cross sectional shape that may decrease in cross-sectional area further away from the insertion surface 412. In other words, the engagement portion 408 tapers to a smaller cross sectional area, which can allow the plug indicator to fit a variety of openings with varying diameters and shapes, such as circular opening and/or square openings. The tapered shape of the engagement portion 408 can allow at least a portion of the engagement portion 408 to directly contact one or more surfaces on the opening (e.g., the third opening 117), and generate enough static friction to couple the engagement portion 408 to the opening and allow the plug indicator 400 to remain in place in the opening.

In some embodiments, the engagement portion can include a number of fins that from the cross cross-sectional shape. For example, the engagement portion 408 can include a first fin 408A, a second fin 408B, a third fin 408C, and a fourth fin 408D. The fins 408A-D can be regularly spaced in a circular fashion. For example, the fins 408A-D can be angularly spaced about ninety degrees apart. Thus, some of the fins may be perpendicular to each other (e.g., the first fin 408A and the second fin 408B), which can help the plug indicator 408 remain in place in the opening. The regular spacing of the fins 408A-D can generate regularly distributed static friction between the engagement portion 408 and a surface of the opening, and thus allow the plug indicator 400 to remain in place in the opening.

Figure 5A:
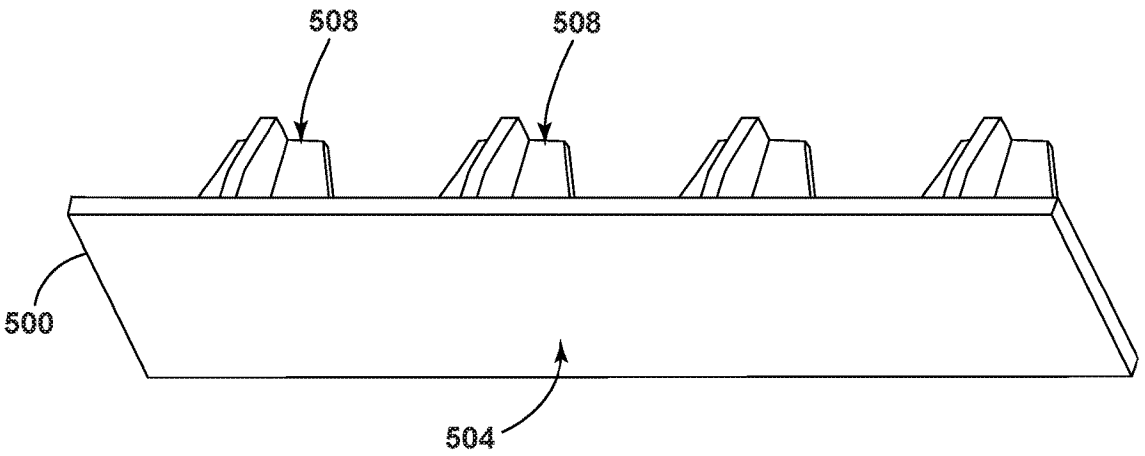
FIG. 5A is a first view of a strip of plug indicators.
Figure 5B:
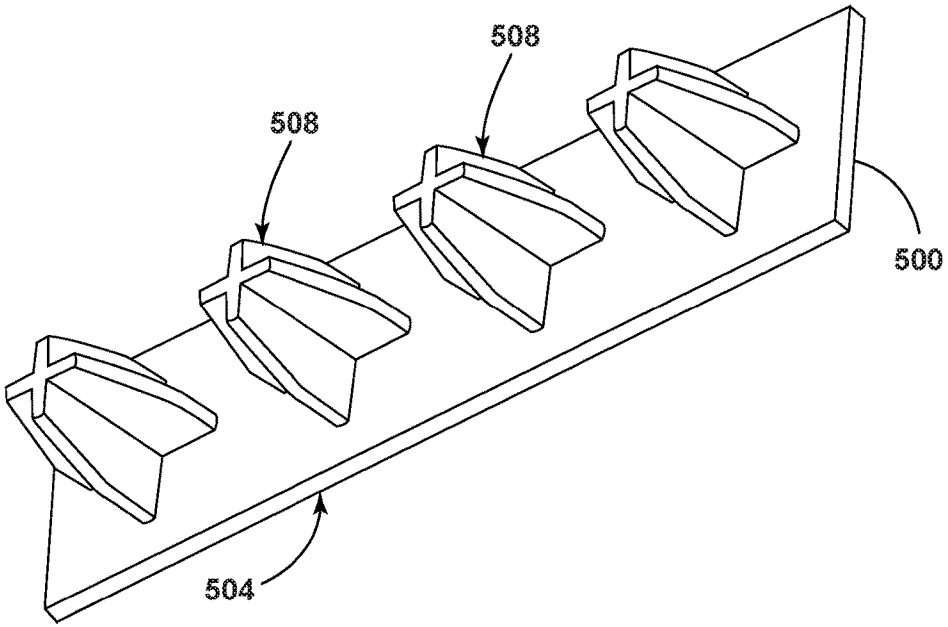
FIG. 5B is a second view of the strip of plug indicators of FIG. 5A.

Referring now to FIGS. 4A and 4B, as well as FIGS. 5A and 5B, a strip 500 of plug indicators is shown. The strip 500 can include a plurality of plug indicators 508 extending from a film 504. The plug indicators 508 can be individually removed from the film 504 and installed on an industrial automation device. In some embodiments, the strip 500 can include a number of indicators identical to the plug indicator 400 in FIGS. 4A and 4B.

Although the invention or inventions are described throughout this disclosure in terms of various apparatuses and devices, one of skill in the art will readily understand that the operational aspects and/or configurations disclosed herein may also be suitably described as one or more methods.

The present disclosure describes preferred embodiments with reference to the Figures. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Although the above discussion discloses various exemplary embodiments of the invention, it should be apparent that those skilled in the art can make various modifications that will achieve some of the advantages of the invention without departing from the true scope of the invention.

What is claimed is:

1. An industrial automation device indicator system comprising:

a plurality of indicators; and a plurality of industrial automation devices positioned in side by side orientation to one another, each of said plurality of industrial automation devices having a housing with a front face and being included in a plurality of housings, the front face sized and adapted to receive an indicator included in the plurality of indicators, the indicator included in the plurality of indicators being formed in an L-shape and positioned on a corner of the front face, each of the indicators in the plurality of indicators being positioned on a housing included in the plurality of housings in a common orientation to one another, wherein a first industrial automation device included in the plurality of industrial automation devices comprises inputs for connection to a motor of a first application, and wherein a second industrial automation device included in the plurality of industrial automation devices comprises inputs for connection to a motor of a second application, the first industrial automation device and the second industrial automation device being adjacent to one another.

2. The system of claim 1, wherein a first indicator included in the plurality of indicators is a first color, the first indicator being coupled to the first industrial automation device, and wherein a second indicator included in the plurality of indicators is a second color, the second indicator being coupled to the second industrial automation device.

3. The system of claim 1, wherein each indicator included in the plurality of indicators comprises at least one of rubberized plastic or silicone.

4. The system of claim 1, wherein the plurality of industrial automation devices includes at least one of a variable speed drive, a circuit breaker, a disconnect switch, an overload relay, or a motor starter.

5. The system of claim 1, wherein a first indicator included in the plurality of indicators is patterned in color.

6. The system of claim 1, wherein is the plurality of housing have different housing constructions.

7. The system of claim 1, wherein the indicator included in the plurality of indicators is configured to change color in response to temperature changes in order to indicate an operating temperature of the industrial automation device.

8. The system of claim 1, wherein the indicator included in the plurality of indicators is coupled to the corner of the front face without requiring one of an adhesive or a fastener.

9. The system of claim 1, wherein the indicator included in the plurality of indicators is configured to stretch over and grip the corner of the front face in order to couple the indicator to the housing.

10. The system of claim 1, wherein the indicator included in the plurality of indicators is formed using an injection molding process.

11. The system of claim 3, wherein each indicator included in the plurality of indicators further comprises at least one of polypropylene, polyamide, or polybutylene terephthalate.

12. An indicator configured to be coupled to a housing of an industrial automation device, the indicator comprising at least one of rubberized plastic or silicone, with an engagement portion sized to be at least partially inserted into an opening included in the housing of the industrial automation device to couple the indicator to the industrial automation device without a fastener, wherein the indicator is configured to change color in response to temperature changes in order to indicate an operating temperature of the industrial automation device.

13. The indicator of claim 12, wherein the engagement portion extends away from an insertion surface.

14. The indicator of claim 13, wherein a cross sectional area of the engagement portion is cross shaped.

15. The indicator of claim 13, wherein a cross sectional area of the engagement portion decreases as the engagement portion extends further away from the insertion surface.

16. The indicator of claim 12, wherein the indicator indicates a system group that includes the industrial automation device.

17. The indicator of claim 16, wherein the industrial automation device is a disconnect switch.

18. The indicator of claim 12, wherein the indicator is configured to display a first color at a first temperature threshold and a second color at a second temperature threshold.

19. The indicator of claim 12, wherein the opening included in the housing is a screw hole.

* * * * *